United States Patent [19]

Kiwaki et al.

[11] Patent Number: 4,768,215

[45] Date of Patent: Aug. 30, 1988

[54] X-RAY GENERATOR WITH CURRENT MEASURING DEVICE

[75] Inventors: Hisakatsu Kiwaki, Katsuta; Kayo Shimada, Hitachi; Hiroshi Okubo, Mito; Kazuo Kaneko, Omiya; Takanobu Hatakeyama, Ryugasaki, all of Japan

[73] Assignees: Hitachi Medical Corporation; Hitachi, Ltd., both of Tokyo, Japan

[21] Appl. No.: 863,501

[22] Filed: May 15, 1986

[30] Foreign Application Priority Data

May 17, 1985 [JP] Japan ..... 60-103783

[51] Int. Cl.[4] ..... H05G 1/10

[52] U.S. Cl. ..... 378/101; 174/85; 324/117 R; 324/127; 378/98; 378/110

[58] Field of Search ..... 378/15, 101, 109, 110, 378/194, 210, 98; 174/85; 324/117 R, 127

[56] References Cited

U.S. PATENT DOCUMENTS

| | | | |
|---|---|---|---|
| 3,061,665 | 10/1962 | Russ et al. | 174/85 |
| 3,323,056 | 5/1967 | Huley | 324/117 |
| 4,104,525 | 8/1978 | Franke | 378/194 |
| 4,424,410 | 1/1984 | Edgerton | 174/85 |
| 4,573,184 | 2/1986 | Tanaka et al. | 378/105 |
| 4,586,970 | 5/1986 | Ishise et al. | 174/85 |

FOREIGN PATENT DOCUMENTS

| | | | |
|---|---|---|---|
| 0689619 | 6/1964 | Canada | 174/85 |
| 0175499 | 11/1985 | Japan . | |
| 0853339 | 11/1960 | United Kingdom | 174/85 |

OTHER PUBLICATIONS

"General View of Medical Radiation Appliances Technology in 1984", by Institute of Radiation Appliances Industry.

*Primary Examiner*—Craig E. Church
*Assistant Examiner*—John C. Freeman
*Attorney, Agent, or Firm*—Antonelli, Terry & Wands

[57] ABSTRACT

An X-ray generator with current measuring device has an X-ray tube, a power supply unit for feeding high voltage to the X-ray tube, a high voltage cable for connecting the X-ray tube and power supply unit. The high voltage cable is comprised of a core conductor, an insulating layer surrounding the core conductor and a covered shield surrounding the insulating layer and the covered shield is disconnected near one end of the cable connected to the X-ray tube so as to be divided into a major shield portion adjacent to the power supply unit and a minor shield portion adjacent to the X-ray tube. An insulating member is provided for electrically insulating the major and minor shield portions, and a magnetic sensor sensitive to a magnetic field generated by a current flowing through the high voltage cable is positioned around the minor shield portion. The X-ray generator can measure the X-ray tube current accurately and readily under electrical insulation.

9 Claims, 3 Drawing Sheets

X-RAY GENERATOR WITH CURRENT MEASURING DEVICE

BACKGROUND OF THE INVENTION

This invention relates to an X-ray generator with current measuring device and more particularly to a current measuring device for use with an X-ray generator suitable for measuring currents of an X-ray tube accurately and readily under electrical insulation.

According to "General View of Medical Radiation Appliances Technology in 1984" edited by The Institute of Radiation Appliances Industry, a corporate juridical person, pp 251–254, the conventional method of measuring X-ray tube current falls into measurement at a neutral point and measurement at a high voltage point of the high voltage circuit. In the former, the neutral point of output voltage from the power supply unit feeding high voltage to the X-ray tube is grounded and an output current of the power supply unit is detected near the neutral point as a voltage drop across a shunt resistor. In X-ray generators, since the X-ray tube is applied with a maximum of about 150 KV of high voltage, the high voltage cable is used to connect the power supply unit to the X-ray tube. Current charging the high voltage cable adds to the X-ray tube current and a resultant current, amounting to a peak value which is ten times as large as that of the X-ray tube current, comes into the neutral point. The output current from the power supply unit detected at the neutral point therefore contains a large error factor due to the charging current. This disadvantageously prevents accurate measurement of the X-ray tube current. Moreover, noise and surge generated in the high voltage circuit passes through the shunt resistor to interfere with the X-ray control unit, causing the X-ray generator to operate erroneously.

In the latter measurement of the X-ray tube current at the high voltage circuit point, the X-ray tube current per se can be measured accurately but because of the high voltage, 150 KV in the extreme, applied to the high voltage circuit at which the measurement is implemented, the X-ray tube current must obviously be measured by means of an instrument electrically insulated from the high voltage circuit. For measurement under electrical insulation, there are known and available typical types of measurement based on photoelectric conversion and magneto-electro conversion. A measuring instrument of either type is inserted into the high voltage circuit and therefore its structure is necessarily complicated and can be obtained only through a sophisticated expensive manfacturing process. Accordingly, such a measuring instrument may be employed for inspection or evaluation of the X-ray generator but it can not be a commercial product which can conveniently be incorporated into the X-ray generator to participate in continuous measurement and control of the X-ray tube current.

Japanese Utility Model Unexamined Publication No. 60-175499 discloses that the current of an X-ray tube can be measured by using a magnetic sensor such as a hall element at the high-voltage cable of the X-ray device.

SUMMARY OF THE INVENTION

It is therefore an object of this invention to provide an X-ray generator with current measuring device capable of measuring the X-ray tube current accurately and readily under electrical insulation.

The present invention is featured in that in order to eliminate the influence of a charging current flow in a covered shield of the high voltage cable upon an X-ray tube current flow in a core conductor of the high voltage cable, the covered shield is disconnected at a point near one end of the cable connected to the X-ray tube so that the charging current flow is divided into two branch flows, and a magnetic sensor sensitive to a magnetic field generated by the X-ray tube current flow is provided which surrounds a portion of the high voltage cable in which the lesser of two branch flows or no appreciable branch flow passes, so as to measure an amount of X-ray tube current on the basis of an output signal of the magnetic sensor generated in response to the X-ray tube current flow.

DESCRIPTION OF THE PREFERRED EMBODIMENTS

Figure 1:
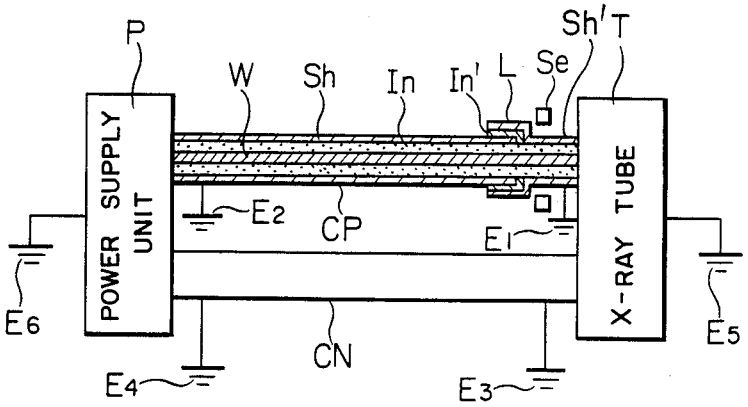
FIG. 1 is a schematic circuit diagram illustrating an X-ray generator with current measuring device according to an embodiment of the invention.

Referring now to FIG. 1, there is shown an X-ray generator with current measuring device having a power supply unit P for the X-ray generator and an X-ray tube T. The power supply unit P feeds a positive voltage and a negative voltage which are supplied to the X-ray tube T by means of a high voltage cable CP and a high voltage cable CN, respectively. The high voltage cable CP has a core conductor W connected to a high voltage circuit (not shown) of the power supply unit, an insulating layer In surrounding the core conductor W, and an outer shield Sh covering the insulating layer In. In this embodiment, the covered shield Sh is disconnected at a point near one end of the high voltage cable connected to the X-ray tube T, thus dividing the covered shield Sh into a major shield portion, also designated by Sh, adjacent to the power supply unit and a minor shield portion Sh′ separated from the major portion and adjacent to the X-ray tube T. The minor portion Sh′ has an extension L which externally overlaps the major portion Sh to maintain the shielding effect against the core conductor W, and the two portions Sh and Sh′ are electrically insulated from each other by means of an intervening insulating layer In′. A magnetic sensor Se such as a magnetic modulator is positioned around the minor portion Sh′ of the high voltage cable CP to surround it. The power supply unit P is grounded at $E_6$, and the outer casing of the X-ray tube T at $E_5$. The major shield portion Sh of the high voltage cable CP is grounded at $E_2$ near the power supply unit and the minor shield portion Sh′ at $E_1$ near the X-ray tube. Similarly, opposite ends of the high voltage cable CN are grounded at $E_3$ and $E_4$.

Figure 2:
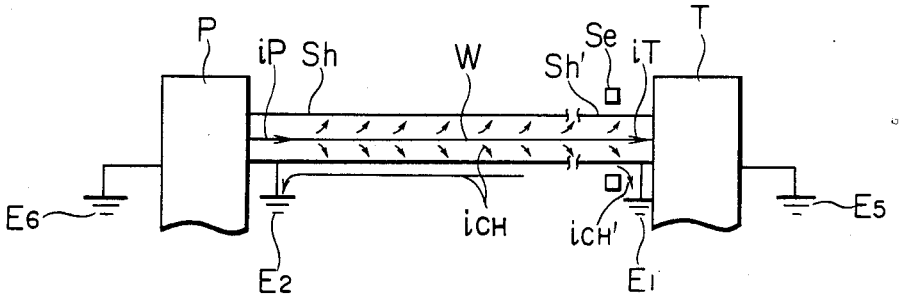
FIG. 2 is a diagram for explaining the operation of the FIG. 1 embodiment.

The operation of the FIG. 1 arrangement will be described with reference to FIG. 2. The positive voltage of the power supply unit P develops, in the core conductor W, an out-flow current $i_p$ directed to the X-ray tube T. Because of electrostatic capacitances (distributed) prevailing between the core conductor W and either of the major portion Sh and minor portion Sh', the current $i_p$ can not be equal to an X-ray tube current $i_T$, but is greater than the X-ray tube current by an amount equal to current flows $i_{CH}$ and $i_{CH}'$ which charge the capacitances. In general, the amount of the charging current $i_{CH}$ or $i_{CH}'$ is in proportion to the corresponding length of the high voltage cable. Especially where, as in this embodiment, the covered shield is intentionally disconnected near the X-ray tube T, the relation between the charging current $i_{CH}'$ flowing out to ground at $E_1$ via the minor shield portion Sh' and the charging current $i_{CH}$ flowing out to ground at $E_2$ via the major shield portion Sh is indicated by $i_{CH}' << i_{CH}$. The charging current $i_{CH}$, returning toward the power supply unit, does not act on the magnetic sensor Se. The charging current $i_{CH}'$, on the other hand, will act on the magnetic sensor Se. However, due to the provision of the shield disconnection near the X-ray tube T, the charging current $i_{CH}'$ is related to the X-ray tube current $i_T$ by $i_{CH}' << i_T$. As a result, practically, magnetic flux acting on the magnetic sensor Se is mainly due to the X-ray tube current $i_T$. Therefore, by measuring the intensity of a magnetic field of the flux, the X-ray tube current $i_T$ can be determined accurately.

In normal modes of use of the X-ray generator, the range of variation of the X-ray tube current $i_t$ is wide, covering 0.1 to 3000 mA. In contrast, the minimum magnetic field intensity Hmin capable of being determined is very small. For example, with a typical high voltage cable having a diameter of about 20 mm, the minimum magnetic field intensity Hmin measured at a circle of 30 mm diameter about the center axis of the high voltage cable is:

$$Hmin = 0.1 \times 10^{-3}(A)/2\pi \times \left(\frac{30}{2}\right) \times 10^{-3}(m) \simeq 10^{-3}(A/m).$$

For example, by using as the magnetic sensor Se a known magnetic modulator whose magnetic path is formed of a ferromagnetic material of large permeability such as permalloy, such an extremely small magnetic field can be measured satisfactorily.

Since in this embodiment the sensor Se is positioned around the covered shield at earth potential, this covered shield fully plays the part of electrical insulation against the high voltage circuit and advantageously, the sensor can be freed from the problem of high voltage insulation and simplified in its structure for considerable easiness of manufacture.

Obviously, the shield disconnection and the sensor both provided for the high voltage cable CP for the illustrative purpose in this embodiment may alternatively be provided for the high voltage cable CN to attain the same effect.

In this embodiment, the overlapped portion is formed such that the shield Sh' overlaps the shield Sh, however the overlapped portion may be formed such that the shield Sh overlaps the shield Sh'.

Figure 3:
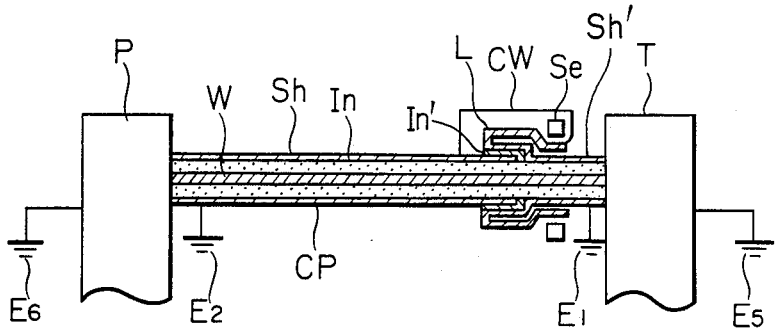
FIG. 3 is a diagram similar to that of FIG. 1 illustrating another embodiment of the invention.
Figure 4:
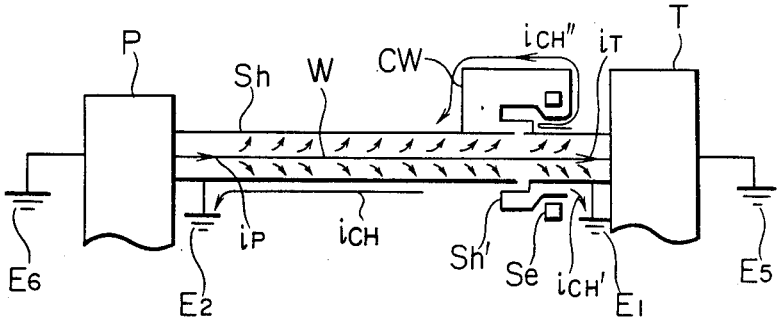
FIG. 4 is a diagram useful in explaining the operation of the FIG. 3 embodiment.

FIG. 3 shows another embodiment of the invention and FIG. 4 illustrates its operation. In FIGS. 3 and 4, identical reference symbols to those of FIGS. 1 and 2 are used to denote the same members and to have the same meaning. The embodiment of FIG. 3 is different from the previous FIG. 1 embodiment in that a minor shield portion Sh' has an overlapping extension added with a contiguous folded part directed to the X-ray tube T, that the folded part passes through the magnetic sensor Se to reach the opposite side of the sensor, and that the free end of the folded part is connected with a connecting wire CW which externally wraps part of the sensor Se to connect to the major shield portion Sh.

With this construction, the charging currents $i_{CH}$ and $i_{CH}'$ are permitted to flow through the same paths as those of the FIG. 1 embodiment and in addition, the charging current $i_{CH}'$ may sometimes branch, as a difference current $i_{CH}''$, from the minor shield portion Sh' to the major shield portion Sh as shown in FIG. 4. However, cooperation of the folded part of the minor shield portion Sh' and the connecting wire CW exactly nullifies any magnetic interference of the difference current $i_{CH}''$ with the magnetic sensor Se. In other words, the difference current $i_{CH}''$ is completely negligible as far as its magnetic influence upon the sensor Se. Consequently, only the charging current $i_{CH}'$, which may be negligible as compared to the X-ray tube current $i_T$, acts on the sensor Se as in the FIG. 1 embodiment. Moreover, the embodiment of FIG. 3 has the further advantage that grounding at $E_1$ for the minor shield portion Sh' and grounding at $E_2$ for the X-ray tube T can be eliminated. In the absence of grounding as such, currents charging stray capacitances associated with the minor shield portion Sh' and X-ray tube T will obviously return to ground at $E_2$ via the connecting wire CW and major shield portion Sh. However, as explained previously, the folded part of the shield portion Sh' cooperates with the connecting wire CW to prevent the sensor Se from sensing the return current to grounding at $E_2$. Thus, possible elimination of grounding at $E_1$ and grounding at $E_5$ can advantageously extend the degree of freedom of X-ray generator installation.

Figure 5:
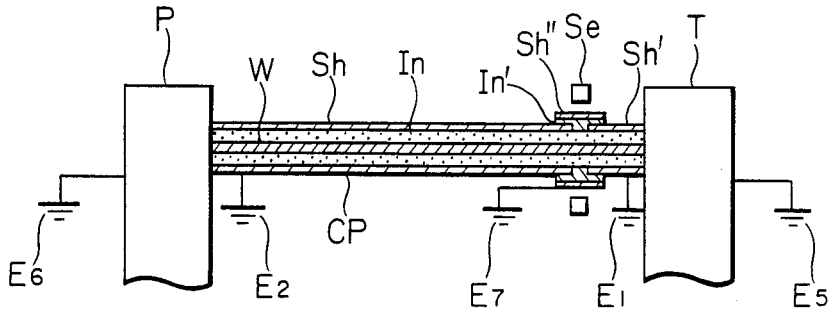
FIGS. 5 and 6 are circuit diagrams showing a further embodiment of the invention with FIG. 6 depicting a modification of the essential part of FIG. 5.

FIG. 5 shows a further embodiment of the invention. Identical reference symbols to those of FIG. 1 are used in FIG. 5 to denote the same members and to have the same meaning. In this embodiment, the covered shield of the high voltage cable is disconnected near the X-ray tube T so as to be divided into major and minor shield portions Sh and Sh', as in the embodiment of FIG. 1. In the FIG. 5 embodiment, the minor shield portion Sh' has no overlapping extensicn and instead, a third shield (separate) Sh'' is provided which surrounds the shield disconnection. The major, minor and separate shields are mutually insulated by means of an insulating layer In'. The separate shield Sh'' is then grounded at $E_7$. Disposition of a sensor Se in this embodiment is different from the FIG. 1 embodiment as surrounding the separate shield Sh''.

Since in this embodiment the overlapping portion L of minor shield portion Sh' as defined by the FIG. 1 embodiment is considered to be separated and replaced with the shield Sh'', the structure near the shield disconnection can be more simplified for easy production thereof while attaining the same effect as in the FIG. 1 embodiment. Even if grounding for the shield portion Sh' and X-ray tube T is impossible or insufficient, the sensor Se can completely be insulated from the high voltage circuit by grounding the shield Sh''.

Figure 6:
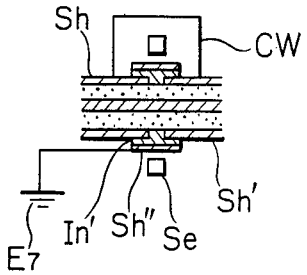

The minor shield portion Sh' is directly grounded in FIG. 5 but may otherwise be grounded at $E_2$ via a connecting wire CW, not passing through the sensor Se, and the major shield portion Sh, as shown in FIG. 6. With this modification, the charging current $i_{CH}''$ will flow through the connecting wire CW but will not affect the sensor Se because the connecting wire CW extends outside the sensor Se.

As described above, according to the invention, the X-ray tube current in the X-ray generator can be measured accurately and readily under electrical insulation, bringing about significant industrial effects.

We claim:

1. An X-ray generator with current measuring device comprising:

an X-ray tube;

a power supply unit for feeding high voltage to the X-ray tube;

a high voltage cable for connecting said X-ray tube and said power supply unit, said high voltage cable including a core conductor, an insulating layer surrounding the core conductor and a covered shield surrounding the insulating layer, said covered shield being separated into two portions, one of said two portions being a longer portion of first predetermined length, and another of said two portions being a shorter portion of a second predetermined length, which is shorter than said first predetermined length so that a charging current to an electrostatic capacitor existing between the core conductor and the covered shield, which is produced by the current flowing through the core conductor, is divided into two portions corresponding to said two portions of said covered shield, one charging current portion corresponding to said shorter portion of said covered shield being negligible as compared to the other charging current portion corresponding to said longer portion of said covered shield;

an insulating member for electrically insulating said two separated portions of said covered shield at the separating position thereof; and a magnetic sensor located outside of said high voltage cable, at a position which is sensitive to a magnetic field produced by the current flowing through the core conductor and the current flowing through said shorter portion of said covered shield.

2. The X-ray generator according to claim 1, wherein said two separated portions of said covered shield overlap each other at said separating position of the covered shield and are grounded at positions in the neighborhood of said X-ray tube and said power supply unit, respectively, said sensor being located between the grounding position of said shorter portion of said covered shield and said separating position of said covered shield.

3. The X-ray generator aaccording to claim 1, wherein said shorter portion of said covered shield overlaps said longer portion of said covered shield and is being provided with a folded extension, said magnetic sensor being arranged outside the folded extension, the end of said folded extension being connected to said longer portion of said covered shield by a connecting wire extending exteriroly of said magnetic sensor.

4. The X-ray generator according to claim 1, wherein said magnetic sensor has a magnetic path formed of a ferromagnetic material.

5. An X-ray generator with current measuring device comprising:

an X-ray tube;

a power supply unit for feeding high voltage to the X-ray tube;

a high voltage cable for connecting said X-ray tube and said power supply unit, said high voltage cable including a core conductor, an insulating layer surrounding the core conductor and a covered shield surrounding the insulating layer, said covered shield being separated into two portions of different predetermined lengths with a gap therebetween such that a charging current of an electrostatic capacitor existing between said core conductor and said covered shield, which is produced by the current flowing through said core conductor, is divided into two portions corresponding to said two portions of said covered shield, one charging current portion of a first covered shield position being negligible as compared to the other charging current portion of a second covered shield portion;

an insulating member for electrically insulating said two separated portions of said covered shield at the separating position thereof;

a shield member surrounding said insulating member; and a magnetic sensor located outside of said shield member, at a position corresponding to said gap between said two portions of said covered shield.

6. The X-ray generator according to claim 5, wherein said insulating member is arranged to cover said gap between said two portions of said covered shield and to partially cover said two portions of said covered shield, said two portions of said covered shield being grounded in the proximity of the X-ray tube and the power supply unit, respectively, and said shield member being grounded.

7. The X-ray generator according to claim 6, wherein said two portions of said covered shield are connected in the proximity of the separating point thereof by a connecting wire extending exteriorly of said magnetic sensor.

8. The X-ray generator according to claim 5, wherein said magnetic sensor has a magnetic path formed of a ferromagnetic material.

9. The X-ray generator according to claim 6, wherein said magnetic sensor is a magnetic modulator whose magnetic path is formed of a ferromagnetic material.

* * * * *